US005480282A

United States Patent [19]

Matson

[11] Patent Number: 5,480,282

[45] Date of Patent: Jan. 2, 1996

[54] HIGH VELOCITY FAN AND YOKE MOUNTING

[75] Inventor: Carl G. Matson, Little Rock, Ark.

[73] Assignee: Triangle Engineering, Jacksonville, Ark.

[21] Appl. No.: 260,874

[22] Filed: Jun. 16, 1994

[51] Int. Cl.[6] ..... F04D 25/10

[52] U.S. Cl. ..... 415/125; 415/213.1; 415/220; 416/100; 416/244 R

[58] Field of Search ..... 416/100, 244 R, 416/246, 247 R; 415/125, 126, 213.1, 220, 222

[56] References Cited

U.S. PATENT DOCUMENTS

| | | | |
|---|---|---|---|
| 2,592,471 | 4/1952 | Sawyer | 415/220 |
| 2,904,298 | 9/1959 | Tateishi | 416/244 R |
| 3,346,174 | 10/1967 | Lievens et al. | 415/222 |
| 4,657,483 | 4/1987 | Bede | 415/222 |
| 4,711,395 | 12/1987 | Handfield | 415/220 |
| 5,368,445 | 11/1994 | Litvin et al. | 416/244 R |

FOREIGN PATENT DOCUMENTS

| | | | |
|---|---|---|---|
| 23301 | 2/1980 | Japan | 415/126 |

*Primary Examiner*—Edward K. Look
*Assistant Examiner*—James A. Larson
*Attorney, Agent, or Firm*—Trent C. Keisling; Stephen D. Carver

[57] ABSTRACT

A high velocity, weather resistant cooling fan for moving large volumes of air long distances can be disposed in either oscillating or non oscillating modes, either inside or outside. A rigid, generally tubular housing has a suitable guard defined on each end. A propeller mounted within the housing, coaxially disposed adjacent an intake venturi, is directly driven by an electric motor. The fan venturi inlet is formed by a flare defined in its housing at the intake end. A transition zone is defined within the tubular housing where the diameter of the flared end gradually reduces and smoothly merges with the uniform diameter of the housing. The propeller is mounted within the transition zone to stabilize air before discharge. A generally U-shaped yoke, rolled from welded, nested channels, pivotally mounts the fan. A stabilizer tube is preferred for sturdily mounting the yoke to a suitable post.

9 Claims, 8 Drawing Sheets

HIGH VELOCITY FAN AND YOKE MOUNTING

BACKGROUND OF THE INVENTION

I. Field of the Invention

The present invention relates generally to high volume, electric cooling fans. More particularly, my invention relates to high volume electric cooling fans, including oscillating fans, that are used for a wide variety of applications both indoors and outdoors.

II. Description of the Prior Art

It has long been recognized in the fan arts that moving air provides a convenient cooling effect. To practically control the effects of wind or air cooling, it is desirable to control the direction, velocity, and volume of the air being driven.

Many prior art electrical fans were equipped with adjustable mounts that could be oscillated. Essentially they comprise an electric motor pivoted to a base, and a suitable linkage that is periodically activated to rotate the fan. The linkage typically produces an oscillating effect, where the fan is repetitively directed back and forth over a given area.

Relatively recent fans apply a column of moving air, and use it in more exotic and specific applications. High velocity air is used for spot cooling in many applications. In industrial applications, high velocity fans provide high velocity cooling for workers. Such fans can be used in conjunction with other machine apparatus to cool parts and machines in factories. These types of fans often include an elongated, tubular housing enclosing multi-bladed fans driven at relatively high velocities.

In the prior art it has been required to mount fans relatively close to the area to be cooled because the velocity of the expelled air drops dramatically as it leaves the fan. When expelled air leaves typical fans, extreme turbulence generated by the fan causes the expelled air to mix with surrounding air. The intermixing of the expelled air with the ambient air surrounding the fan results in a drop in volume, speed and pressure of the expelled air. This phenomena requires that the fan be mounted relatively close to the application it is to cool. It is often difficult to mount the fan as close as required to the application.

In order to maximize the distance in which the fan will operate, the air must be concentrated and delivered properly for maximum effect. Concurrently, the fan must be properly mounted upon a suitable structure. It is also desirable to prevent workers from inadvertently contacting the fan, to avoid both mechanical and electrical injury. It is generally prohibited to mount fans with extension cords and other exposed electrical wiring.

Some high velocity fans are employed on golf courses to prevent molding of the greens during periods of still air. Some prior art golf course fans have discharge openings which reduce velocity and spread air flow to increase turbulence in the expelled air. Known overhead fans have no venturi housing to control air flow. Most fans have no means to polarize the flow or to reduce the rolling and twisting turbulence of the expelled air. Thus it is desirable to provide a fan which is adapted for long range air distribution. It is important to provide a stabilized, high volume output so that the air can be directed as easily as possible.

SUMMARY OF THE INVENTION

I have provided a high velocity cooling fan for moving large volumes of air long distances. The fan is relatively easy to mount, it can be disposed in either oscillating or non oscillating modes, and it can be employed satisfactorily either inside or outside.

The fan comprises a rigid, generally cylindrical tubular housing having a suitable guard defined on each end. A direct drive electrical fan is mounted within the housing, coaxially disposed adjacent an intake venturi. The fan venturi inlet is formed from a flare defined in its housing at the intake end.

A transition zone or point is defined within the tubular housing where the flared end smoothly merges with the uniform housing. Here the outer diameter of the flared end smoothly transitions to the inner diameter of the body of the cylindrical housing. The fan blade is mounted in this position, adjacent the elongated cylindrical portion of the housing, to stabilize air before discharge. To further stabilize air discharge, the motor mount is shaped as an air foil to reduce the rolling of air. The relatively thin, rolled shape of the construction allows a smooth introduction of air to the static boundary layer air, while maintaining a sturdy structure.

Since many applications require different mounting styles, the fan is adapted to be mounted for oscillating work or for fixed orientations. It may be mounted overhead, or it may be secured to other static structures. To enable gimble mounting and to facilitate overhead and post mounting, a special yoke construction is preferably employed.

The generally U-shaped yoke pivotally mounts to the fan in a balanced fashion, and it is removably coupled to opposite sides of the fan housing. To manufacture the preferred yoke, a pair of nested channels are mated together, with a difference in length of the channels compensating for the difference in circumference they will assume once each channel is rolled into the desired semi-circular shape. The outside portion is one-half the total section thickness, which reduces the tendency for the edge to buckle. In the interest of making a simple rolling procedure, the yoke is rolled in one pass to a one hundred and eighty degree bend. A plate extension is then added to each end to make the remaining straight reach in the form of a separate automatic matching produced part. The extension is welded to the open end of the formed yoke to close the end against weather. The basic design is adaptable to operate as a floor mounted fan. The floor mounted fan can be assembled in three mounting styles with various components.

This fan can be post mounted adjustable, post mounted oscillating, tree or column mounted adjustably, tree column mounted in an oscillating or non-oscillating fashion, or it can be beam mounted oscillating.

Thus a primary object of this invention is to provide a high velocity fan which is adapted to be mounted in a variety of different fashions.

Another important object is to provide a high velocity fan for cooling applications that is adapted to be mounted in a variety of orientations.

Another object is to provide a fan of the character described that totally isolates all rotating blades within a safe, protected shroud to avoid direct human contact.

Another object is to provide a fan capable of providing a high volume of non-turbulent cooling air.

A still further object of this invention is to provide a fan which can oscillate in desired directions and tilt appropriately.

Another object is to provide a highly reliable fan system which moves the maximum amount of air possible through the minimum volume of fan. It is a feature of the present invention that a direct drive fan is employed.

Another important object is to provide a unique venturi effect that enables the fan to project air long distances.

A still further object is to provide a fan which is readily capable of use either inside or outdoors.

Yet another object of my fan is provide a high velocity fan that can be suspended from a ceiling, upon a wall, or mounted upon a pole or similar support.

Still another object is to provide a fan which can oscillate reliably on heavy duty, replaceable bearings.

Another object is to provide a fan which can cool a plurality of industrial workers, to minimize the number of fans which a company may need for proper cooling or ventilation.

A further object is to provide a fan which creates and expels a column of moving air as far as possible.

These and other objects and advantages of the invention, along with features of novelty appurtenant thereto, will appear and become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
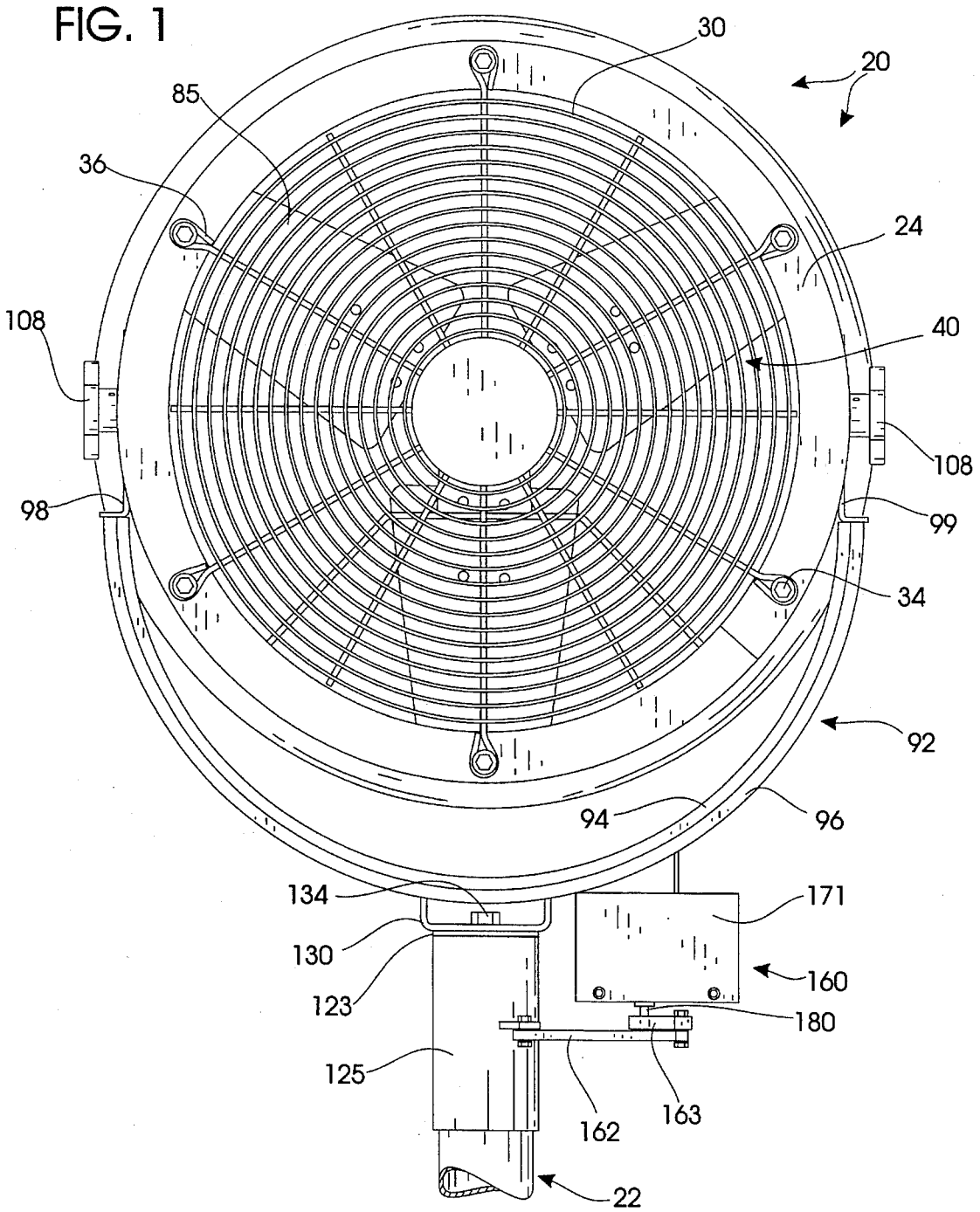
FIG. 1 is a fragmentary front elevational view of the fan constructed in accordance with the best mode of the invention.
Figure 2:
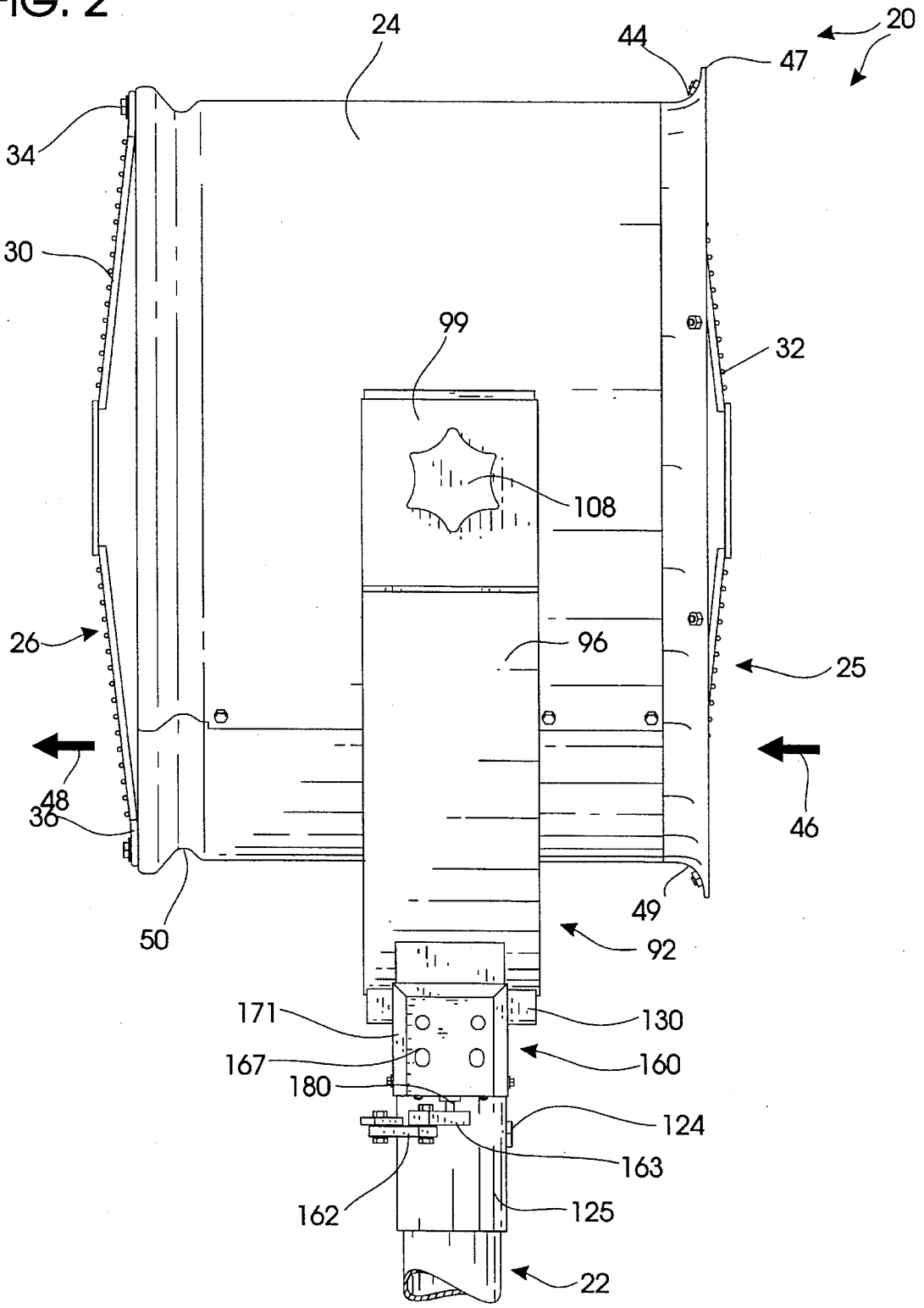
FIG. 2 is a fragmentary right side elevational view of the fan of FIG. 1.
Figure 3:
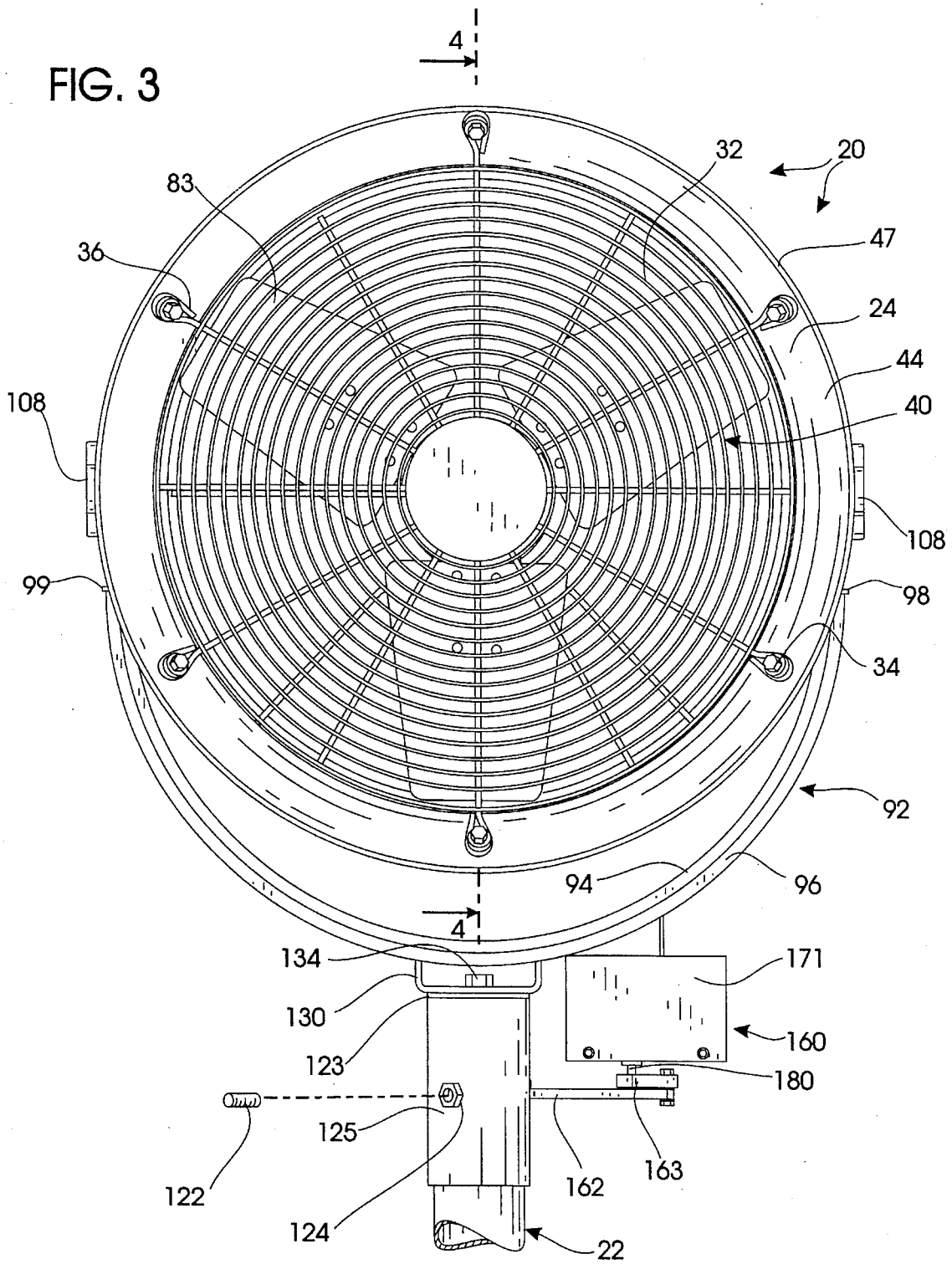
FIG. 3 is a fragmentary rear elevational view thereof.
Figure 4:
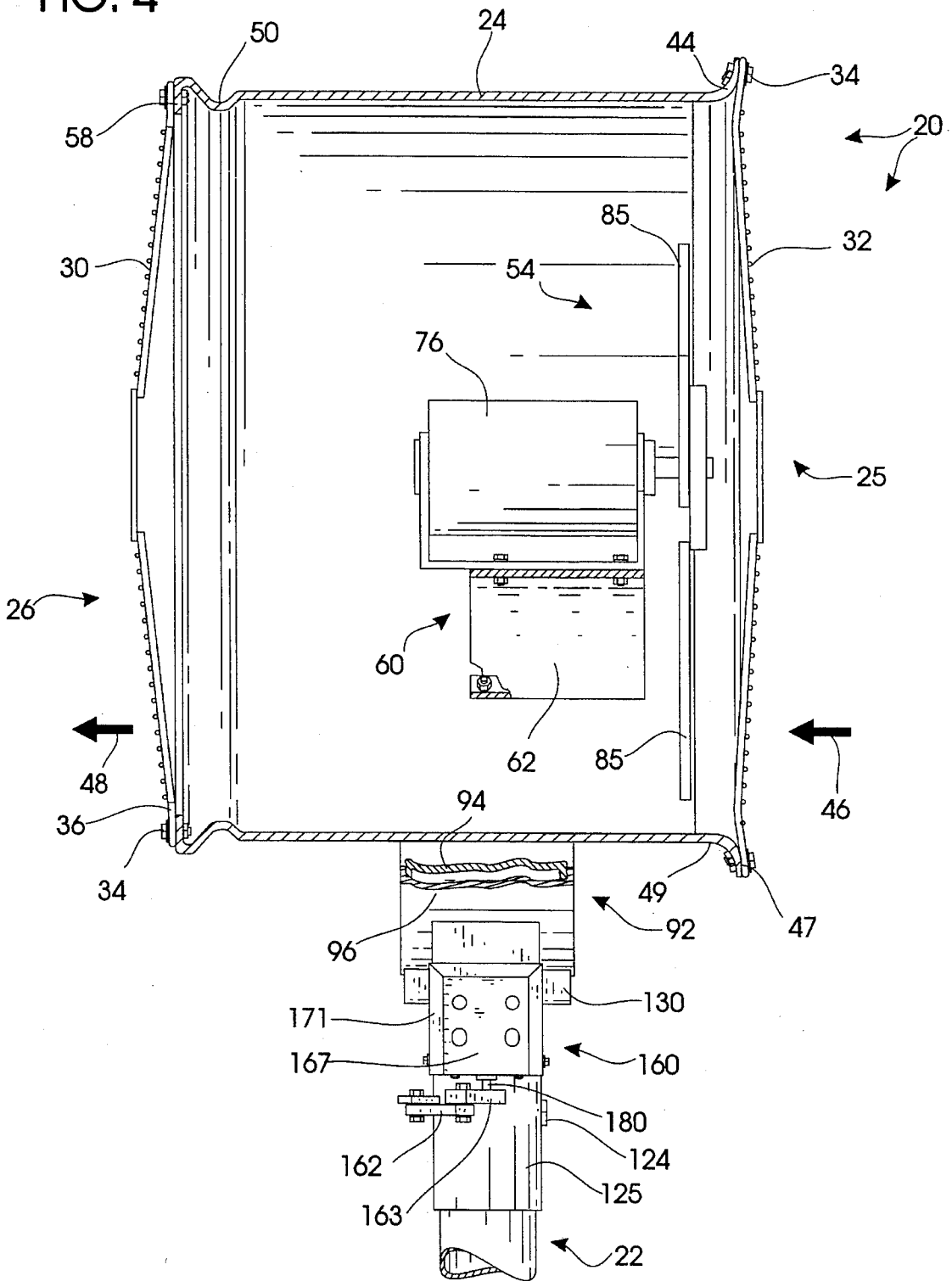
FIG. 4 is a fragmentary longitudinal sectional view thereof, taken generally along line 4—4 of FIG. 3.

With initial reference directed to FIGS. 1–6 of the appended drawings, the best mode of my high velocity cooling fan has been generally designated by the reference numeral 20. Fan 20 may be mounted above ground in a variety of fashions. Ideally it may be mounted to a suitable vertically upright post 22 or the like. The purpose of my new fan is to intake air and to output it in a controlled fashion, minimizing turbulence and rolling, and to direct cooling air as far as possible from the apparatus toward the intended application.

Fan 20 preferably comprises a generally tubular housing 24 having an air intake end 25 and an air output end 26. The elongated, tubular housing 24 includes a front mounted protective grill 30 (FIGS. 1, 6) and a similar rear protective grill 32 fastened with suitable fasteners 34 through spaced apart spokes 36 (FIG. 3) to the front and rear of the housing. This prevents human contact with the preferably three-bladed propeller assembly 40, which is disposed within the housing 24 as will hereinafter be described.

Housing 24 comprises a flared, increased diameter venturi conic ring 44, disposed at its rear end 25, which forms a venturi when air is inputted to the apparatus. Air enters the apparatus as indicated by arrow 46 and exits as indicated by arrow 48. The venturi 44 includes a radially defined, angled larger diameter outer edge portion 47, which surrounds the air intake. A transition zone 49 is defined adjacent the flared edge 47 at which point the diameter of the flared portion is substantially reduced to that of the housing 24. This uniform housing diameter continues to a front, circumferential reinforcing groove 50 which surrounds the apparatus and has a reduced diameter. Groove 50 terminates in an inturned lip portion 58 which is secured to the front guard 30, adjacent the air output end 26.

Importantly, the propeller assembly 40 is mounted interiorly of the fan housing 24, substantially coincident with the transition zone 49. The propeller assembly includes an aerodynamically prepared mounting system 60 having a top 61 and a pair of lower, diverging wings 62, 63, which are adapted to be bolted within the fan housing 24. A mounting plate 70 is secured to top 61, and it includes a pair of spaced apart vertical ends 72 which are rigidly fastened on opposite ends of the direct drive motor 76 by suitable clamping mounts 77. Propeller assembly 40 includes a central hub 80 that is directly keyed to the output shaft 81 of the motor 76 to directly drive the propeller assembly 40. Preferably, hub 80 mounts three outwardly extending arms 84. A blade 85 depends outwardly from each of the arms 84.

In operation, air surrounding the input end 25 is sucked into the fan housing 24 by the rotation of the blades 85. Immediately upon entering the housing 24, the inputted air flows past the venturi 44, the propeller assembly 40 and the mounting system 60. Then the rotation of the propeller assembly 40 forces the inputted air through the housing 24 and against the reduced diameter groove 50. This slight pressurization of the airstream transforms the turbulent input stream into a polarized or laminar output airstream. Most of the turbulent eddies or rolls within the stream are eliminated before the air stream is expelled or output from the output end 26. This polarized stream of output air is capable of traveling long distances before the surrounding ambient air begins to intersperse with it, causing turbulence and drag.

Figure 7:
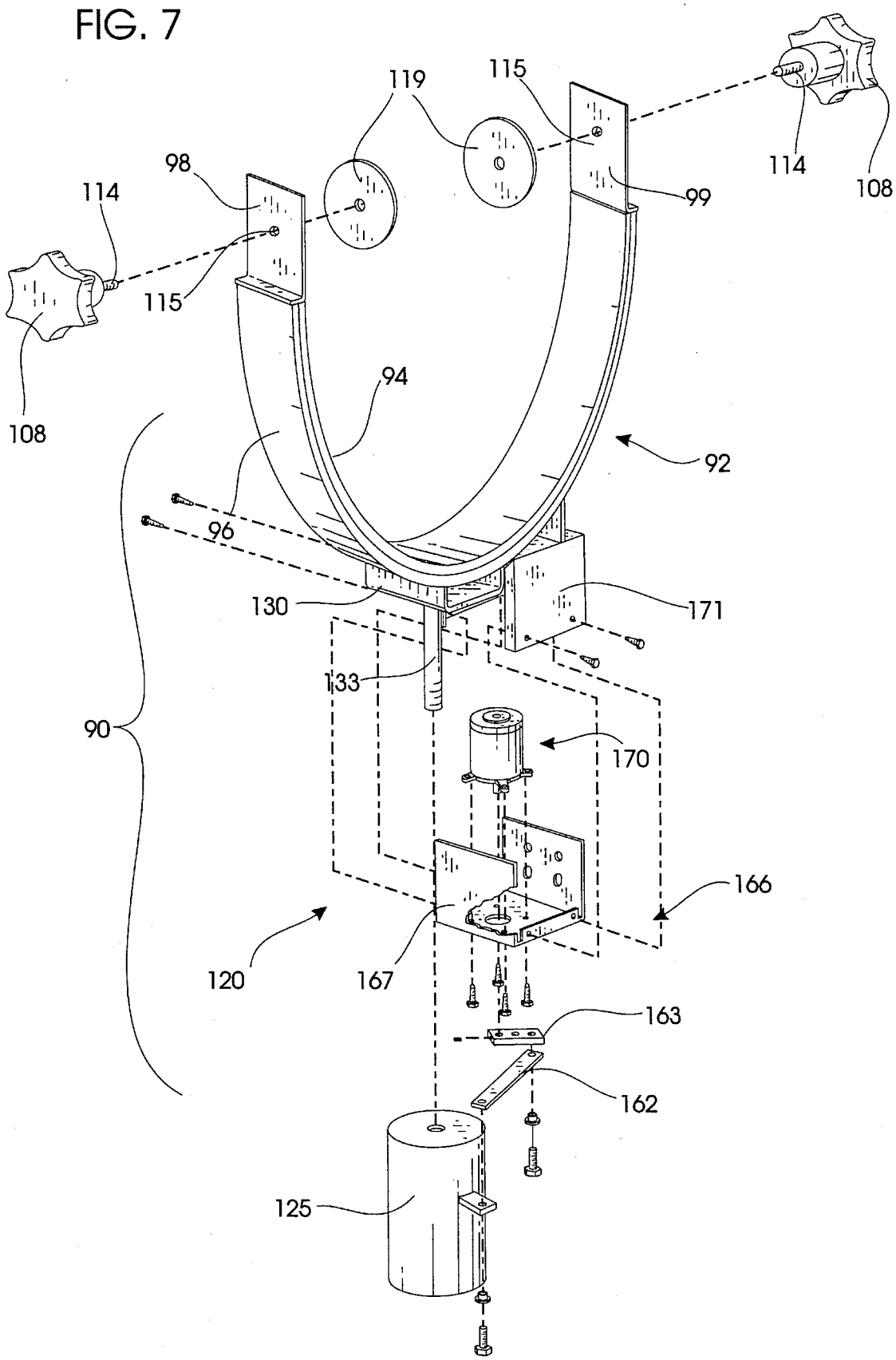
FIG. 7 is an exploded, fragmentary pictorial view of the preferred yoke and mounting construction.
Figure 8:
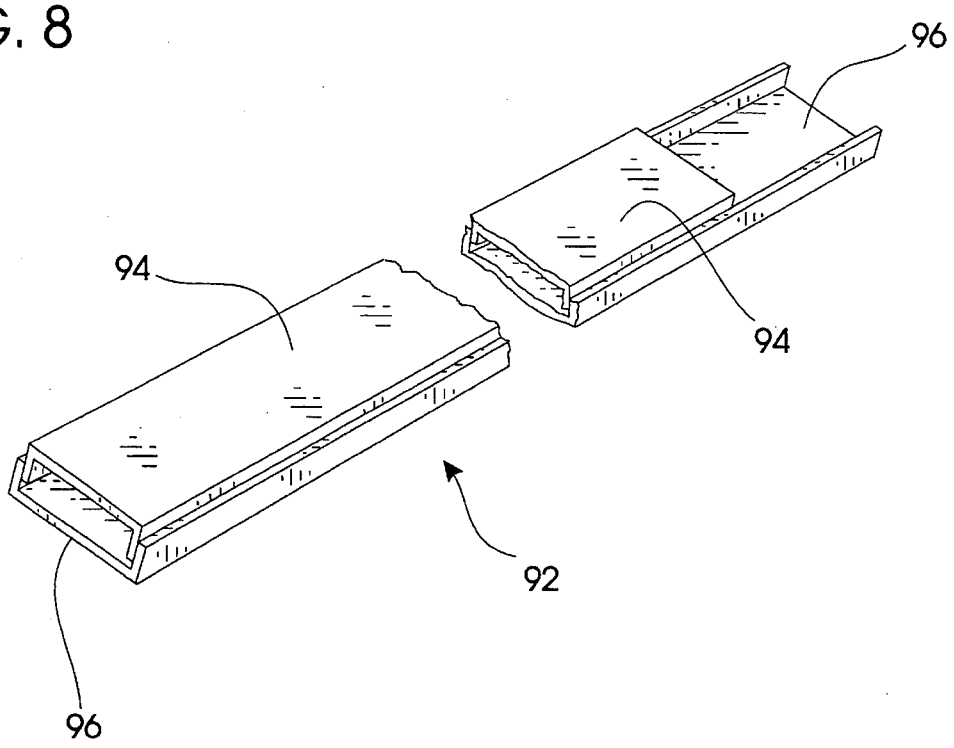
FIG. 8 is a fragmentary, perspective view of the assembled channels aligned for yoke construction; and, FIG. 9 is a fragmentary, perspective view of the preferred yoke rolling step.
Figure 9:
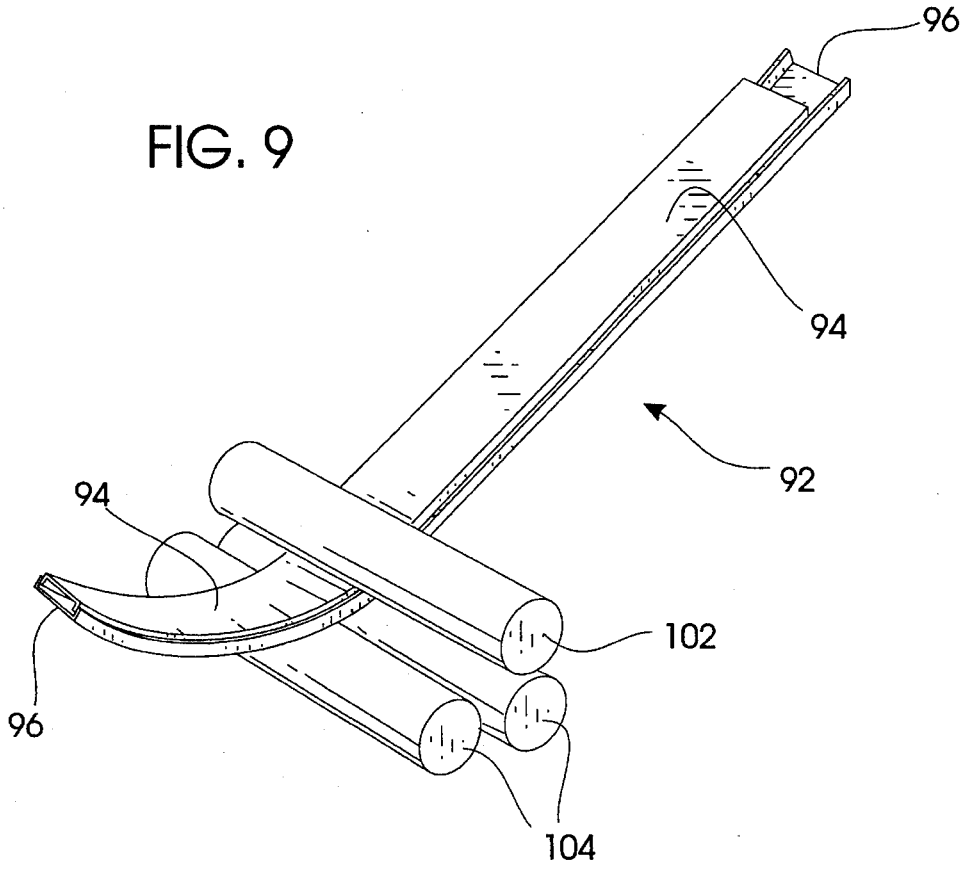

Although the apparatus may be mounted in several fashions, the yoke mounting system 90 of FIG. 7 is preferred. System 90 includes a generally U-shaped yoke 92 which is formed from rolling first and second elongated channel members 94 and 96. Channel member 94 (FIGS. 7–9) is welded to channel 96, but since it will be bent inwardly, it will have a shorter diameter or length. The two channels 94, 96 are lengthwise mated together as in FIG. 8, and then welded. They are bent inwardly through rolling between upper roller 102 and lower rollers 104 (FIG. 9). Through the rolling of the combined channels in the manner described, a rigid, dependable U-shaped yoke results. The U-shaped yoke member 92 is disposed about roughly half of the circular circumference of the housing 24.

Preferably, yoke 92 terminates in a pair of flat, upwardly extending flanges 98, 99 (FIG. 7) that are welded in opposite ends of the yoke. Suitable brackets 100 (FIG. 6) have feet 101 which are secured through fasteners to the mounting holes 103 on opposite sides of the housing 24. Each bracket 100 includes an orifice 109 that threadably receives the shaft 114 of a knurled fastening knob 108 (FIG. 7). Knob 108 facilitates convenient manual adjustments to the fan orientation. Threaded shaft 114 penetrates flange orifice 115 and an aligned mounting washer 119 to securely fasten the yoke to bracket 100. Thus the yoke apparatus 90 securely mounts the fan 20, and the housing 24 may be tilted in a variety of different directions.

Relative rotation about the axis established by the line extending between orifices 115 in brackets 98, 99 allows for upward or downward aiming of the fan about this axis. The housing 24 may thus be pivoted upwardly or downwardly. Concurrently, the housing may be twisted in a plane perpendicular to that axis, which is established by the vertical post 22 previously described.

Figure 5:
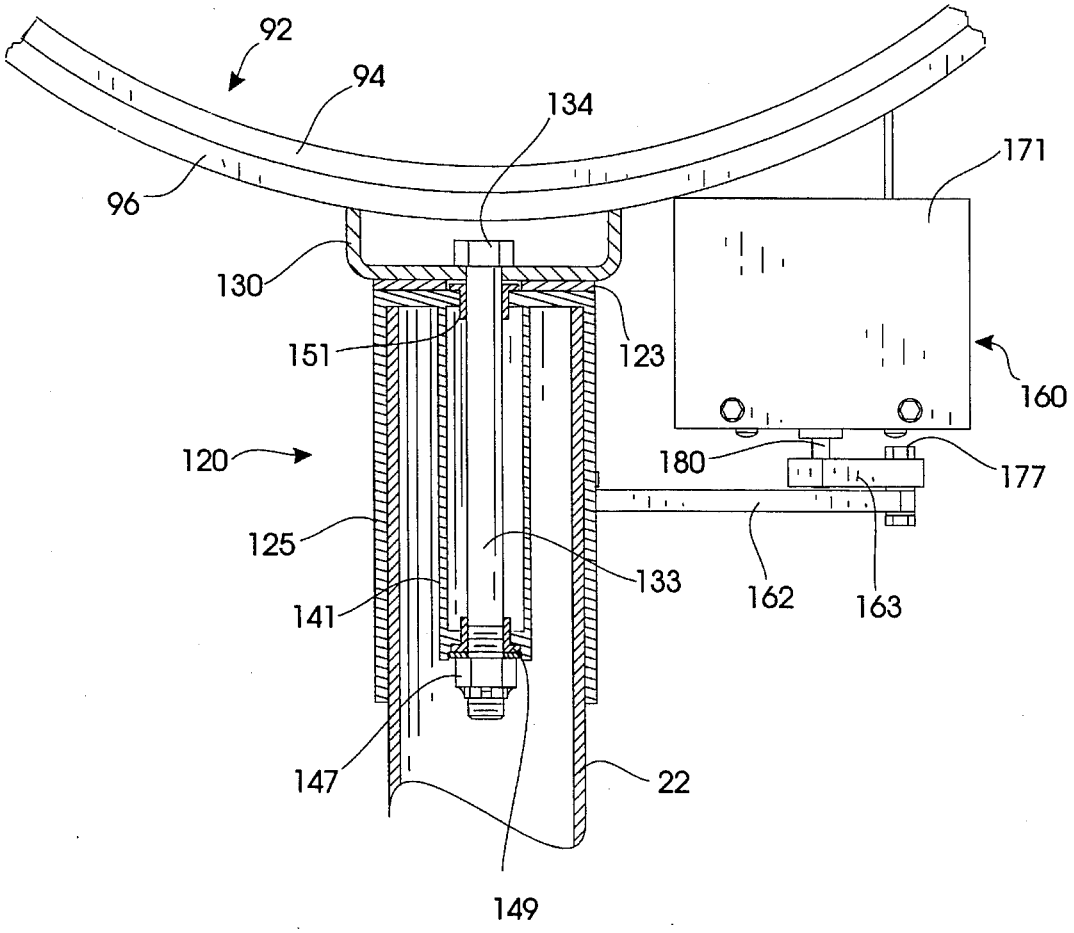
FIG. 5 is an enlarged, fragmentary sectional view of the yoke and rotary cap assembly.
Figure 6:
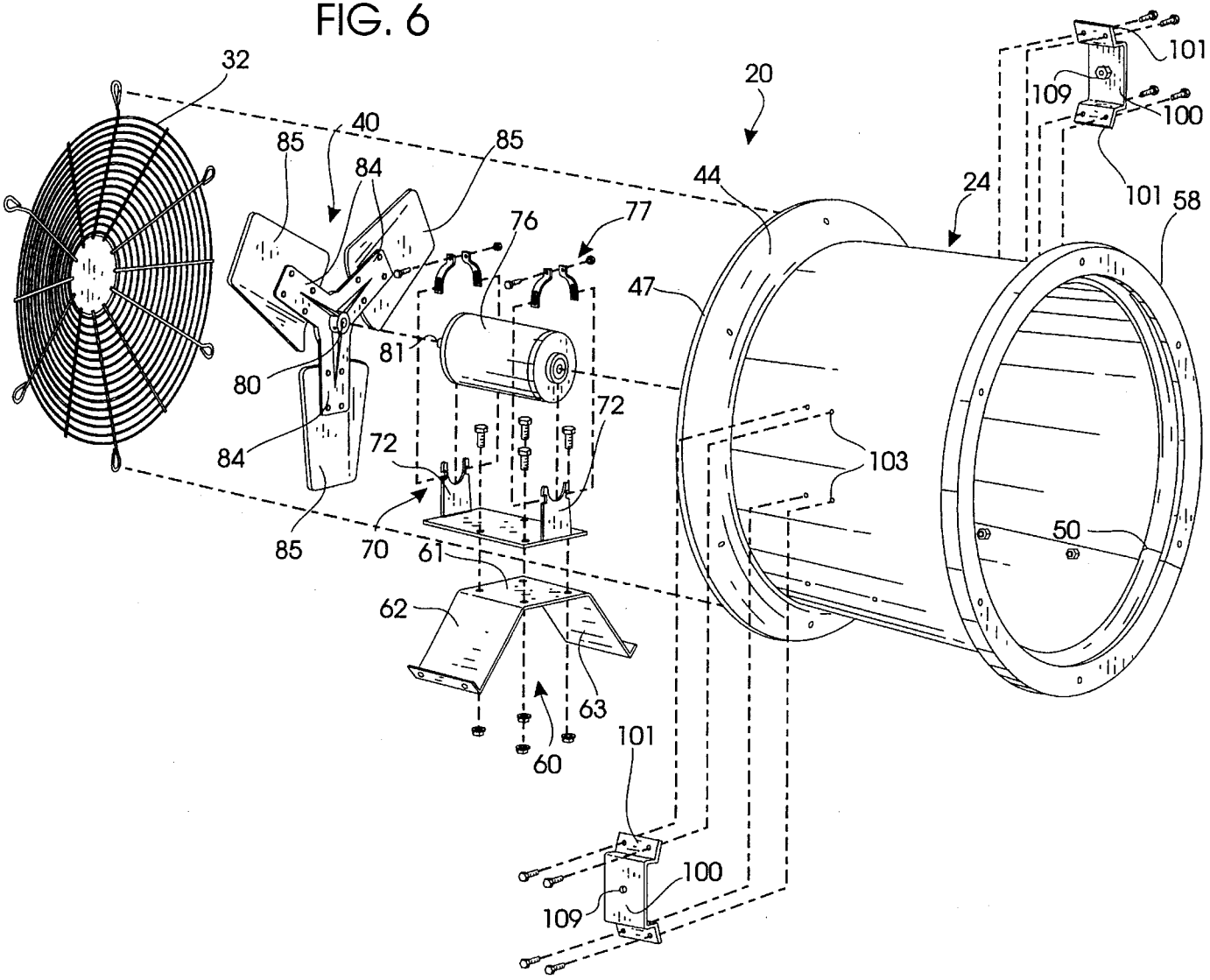
FIG. 6 is an exploded, fragmentary pictorial view of the preferred housing construction.

Preferably the yoke assembly 90 is mounted with a post assembly generally designated by the reference numeral 120 which couples the yoke assembly 92 to the lower supporting stanchion 22 for support (FIG. 5). A rigid, offset planar bracket 130 is welded to the bottom of yoke 92. This bracket is welded to an intermediate flange 123 and the underside of the yoke. Bolt head 134 is captivated within it and welded to it. Rigid bolt shaft 133 projects downwardly from head 134. The yoke and bolt 133 rotate relative to the tubular cap 125 that is coaxially penetrated by bolt shaft 133. Cap 125 coaxially engages pipe 22. Relative rotation between pipe 22 and cap 125 is prevented by bolt 122 (FIG. 3) threaded to socket 124.

A reduced diameter, inner alignment tube 141 is disposed coaxially within cap 125, being welded to the cap top. Tube 141 is penetrated by shaft 133. This tube tends to align the shaft, and stabilize oscillating movements of the fan. Shaft 133 is coaxial with pipe 22 and cap 125. The nut 147 is secured at the bottom of tube 141 against bolt shaft 133. The nut 147 engages an interior bearing grommet 149 which cooperates with grommet 151 to rotatably secure and stabilize the apparatus.

Cap 125 is coupled to an oscillator motor assembly 160 via rigid link 162 and crank 163 which is driven by motor 170 (FIG. 7). Links 162 and 163 are pivoted together with a nut and bolt assembly 177 (FIG. 5). The oscillator frame 167 includes an internal drive motor 170, and frame 167 is mounted to plate 171 (welded to the yoke) to form the housing. Fasteners 166 secure the apparatus. As the output shaft 180 (FIG. 5) of the motor 170 rotates, the crank 163 and linkage 162 rotates the yoke relative to the stationary cap 125. Hence activation of the oscillating assembly will gently rotate the yoke 92 radially about the stanchion 22 in a rocking motion to move the fan arcuately to provide a fresh air stream to a desired location.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, high volume, directional power cooling fan comprising:

an elongated, tubular, generally cylindrical housing adapted to be aimed at a target area to be cooled, said housing comprising an air intake end and a high velocity air output end;

a rotatable propeller assembly coaxially disposed within said housing adjacent said air intake end;

said air intake end of said housing comprising a flared portion separated from a main tubular body portion of the housing by a transition zone, whereby to form a venturi air inlet;

wherein said propeller assembly is disposed at said transition zone;

direct drive motor means for rotating said propeller assembly;

means for securing said motor means within said housing;

generally U-shaped yoke means for mounting said fan; and, oscillating means for periodically rotating said yoke means.

2. The power cooling fan as defined in claim 1 further comprising means for mounting said yoke means to a vertical post, said last mentioned mounting means comprising a tubular cap adapted to be coaxially secured to said post, an alignment tube disposed coaxially within said cap, and an axially elongated, rotatable shaft extending coaxially within said alignment tube having a head secured to said yoke means.

3. The power cooling fan as defined in claim 2 wherein said yoke means is comprised of two nested channels which are mated to one another and thereafter rolled into a substantially U-shaped configuration.

4. The power cooling fan as defined in claim 3 wherein said housing comprises a pair of sides, said yoke means comprises a pair of sides, and said yoke means comprises a plate extension formed on each of its sides adapted to be threadably pivotally coupled to said sides of said housing.

5. A high volume, directional power cooling fan comprising:

an elongated, tubular, generally cylindrical housing adapted to be remotely disposed and aimed at a target area to be cooled, said housing comprising an air intake end and a high velocity air output end;

a rotatable propeller coaxially disposed within said housing adjacent said air intake end;

said air intake end of said housing comprising a flared portion separated from a main tubular body portion of said housing by a transition zone, said flared portion forming a venturi air inlet;

wherein said propeller is disposed adjacent said transition zone;

motor means for rotating the propeller;

mounting means for securing the motor means coaxially within the housing, said mounting means reducing the rolling of air; and, yoke means for mounting the fan, said yoke means comprising two nested channels which are mated to one another and thereafter rolled into a rigid, substantially U-shaped yoke adapted to be releasably coupled to opposite outer sides of said housing.

6. The power cooling fan as defined in claim 5 wherein said yoke further comprises a plate extension formed on each side adapted to be threadably pivotally coupled to said sides of said housing.

7. A portable, high volume, directional power cooling fan comprising:

an elongated, tubular, generally cylindrical housing adapted to be disposed adjacent and aimed at a target area to be cooled, said housing comprising an air intake end and a high velocity air output end;

a rotatable propeller coaxially disposed within said housing adjacent said air intake end;

said air intake end of said housing comprising a flared portion separated from a main tubular body portion of the housing by a transition zone, whereby to form a venturi air inlet;

wherein said propeller is disposed at said transition zone;

direct drive motor means for rotating the propeller;

mounting means for securing the motor means within the housing, said mounting means reducing the rolling of air, generally U-shaped yoke means for mounting the fan; and, means for mounting said yoke means to a vertical post, said last mentioned mounting means comprising a tubular cap adapted to be coaxially secured to said post, a reduced diameter alignment tube disposed coaxially within said cap, and an axially elongated rotatable rigid bolt extending coaxially within said alignment tube having a head secured to said yoke means.

8. The power cooling fan as defined in claim 7 wherein said yoke means comprises two nested channels which are mated to one another and thereafter rolled into a substantially U-shaped configuration.

9. The power cooling fan as defined in claim 8 wherein said housing comprises a pair of sides, said yoke means comprises a pair of sides, and said yoke means comprises a plate extension formed on each of its sides adapted to be threadably pivotally coupled to said sides of said housing.

* * * * *